US007350485B2

(12) United States Patent
Jacquay

(10) Patent No.: US 7,350,485 B2
(45) Date of Patent: Apr. 1, 2008

(54) ENGINE COOLING FAN SHROUD

(75) Inventor: Brian J. Jacquay, New Haven, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/557,628

(22) Filed: Nov. 8, 2006

(65) Prior Publication Data

US 2007/0062468 A1 Mar. 22, 2007

Related U.S. Application Data

(62) Division of application No. 10/929,996, filed on Aug. 30, 2004, now Pat. No. 7,165,515.

(51) Int. Cl.
*F01P 7/10* (2006.01)

(52) U.S. Cl. ..... 123/41.49; 416/179; 29/888.025

(58) Field of Classification Search ..... 123/41.49, 123/41.7, 41.63, 41.65, 41.56; 415/214.1; 416/179; 29/888.025; 165/121–125
See application file for complete search history.

(56) References Cited

U.S. PATENT DOCUMENTS 4,522,160 A * 6/1985 Speers et al. ..... 123/41.49
4,566,852 A * 1/1986 Hauser ..... 415/220
5,701,854 A * 12/1997 Hauser ..... 123/41.49
2006/0112909 A1* 6/2006 Esau et al. ..... 123/41.49
2007/0277752 A1* 12/2007 Smith et al. ..... 123/41.49

FOREIGN PATENT DOCUMENTS

WO WO 98/37319 * 8/1998

* cited by examiner

*Primary Examiner*—Hai Huynh
(74) *Attorney, Agent, or Firm*—Jeffrey P. Calfa; Gerald W. Askew

(57) ABSTRACT

A fan (16) draws air through a core (14) of a radiator (10) to which coolant from coolant passages in an engine (12) rejects heat. A shroud (28) having first and second parts (30, 32) in axial succession channels air that has been drawn through the core toward the fan. The first part (30) is a non-elastomeric ring, and the second part (32) has an elastomeric ring (34) having opposite axial ends, one of which telescopically fits to the non-elastomeric ring of the first part (30) and the other of which joins with a second non-elastomeric ring (36).

5 Claims, 1 Drawing Sheet

ENGINE COOLING FAN SHROUD

This is a division of application Ser. No. 10/929,996, filed Aug. 30, 2004 now U.S. Pat No. 7,165,515.

FIELD OF THE INVENTION

This invention relates generally to cooling systems of internal combustion engines in motor vehicles. More specifically it relates to a novel construction for a cooling fan shroud that channels air from a core of a radiator toward a fan that draws the air through the core.

FIELD OF THE INVENTION

A common cooling system for an internal combustion engine that powers a motor vehicle comprises a radiator behind which is an engine-driven fan. A radiator-mounted shroud channels air that the fan draws through the radiator core toward the fan.

In general, fan efficiency increases as the radial clearance between the fan blade tips and the shroud wall is minimized. Engine-mounted ring shrouds are sometimes used to minimize this distance, but usually comprise multiple components, including a base shroud, an elastomeric seal, an extruded ring, and mounting hardware. Care must be taken to assure some clearance so that the blade tips do not contact the shroud wall.

It is believed that installation of a shroud in a motor vehicle could be made easier, and the fit made better, if fewer parts and assembly steps were required.

SUMMARY OF THE INVENTION

Providing a less complicated construction, with fewer parts and assembly steps, is one objective of the present invention.

Briefly, a preferred embodiment of the invention comprises a one-piece shroud comprising a non-elastomeric synthetic ring having molded-in mounting features, and a flexible elastomeric ring that joins with the synthetic ring. Fabricating the synthetic ring by injection molding from a material like nylon renders the synthetic ring durable and dimensionally stable. The flexible ring extends frontally of the synthetic ring for sealing to the rearward margin of a base shroud that is attached to and extends rearward of the radiator.

The use of an injection molding process for making the synthetic ring provides the ability to set a desired ring profile and to set the percent fan penetration by appropriate dimensioning of the molding cavity. Joining the flexible ring and the nylon ring by a process where the materials bond to each other eliminates the need for attaching parts to join the two rings.

The nylon ring may be fabricated by injection molding to have designed-in mounting features that offer the ability to rigidly mount the ring to the front engine mount and front engine cover. The elastomeric section is designed to have interference to the base shroud creating a sealed joint between the two.

The construction allows for easy adjustment of fan penetration, reduces installation time, and can be used across multiple product lines.

A one-piece part comprising a non-elastomeric synthetic ring and a flexible elastomeric ring, as described, provides a shroud construction that can be easily installed, allows for variable lip profiles, and includes mounting features which creates the ability to modify percent fan penetration.

One generic aspect of the present invention relates to an engine comprising engine structure that defines combustion chambers in which fuel is combusted to run the engine and coolant passages through which coolant is circulated to absorb some of the heat of combustion. A fan draws air through a core of a radiator to which coolant from the coolant passages in the engine structure rejects heat. A shroud for channeling air that has been drawn through the core toward the fan comprises first and second parts in axial succession. The first part comprises a non-elastomeric ring, and the second part comprises an elastomeric ring having opposite axial ends, one of which telescopically fits to the non-elastomeric ring of the first part and the other of which joins with a second non-elastomeric ring.

Another generic aspect relates to an engine and fan, as described, with a shroud for channeling air drawn through the radiator core toward the fan. The shroud comprises a part comprising a non-elastomeric ring and an elastomeric ring joined to each other through a bond of elastomeric material of the elastomeric ring with non-elastomeric material of the non-elastomeric ring.

Still another generic aspect relates to a shroud part comprising a non-elastomeric ring and an elastomeric ring joined to each other through a bond of elastomeric material of the elastomeric ring with non-elastomeric material of the non-elastomeric ring.

The invention also includes a method of making a shroud part for a shroud that channels air that an engine cooling fan has drawn through a radiator core toward the fan. The method comprises providing a non-elastomeric synthetic ring and joining an elastomeric ring to the synthetic ring by bonding elastomeric material of the elastomeric ring with non-elastomeric material of the non-elastomeric ring.

The foregoing, a long with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
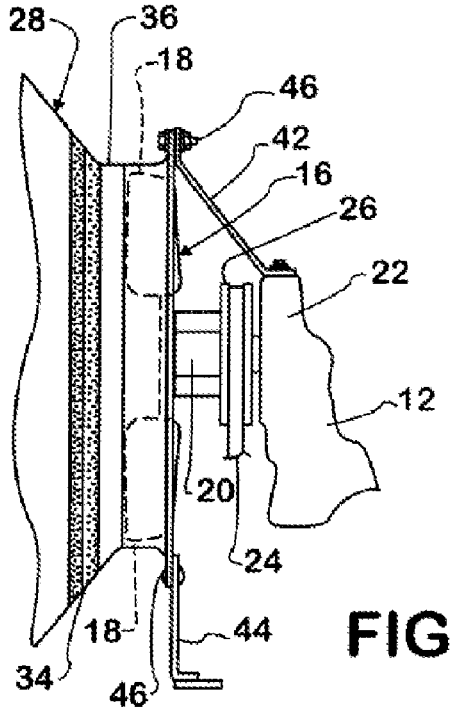
FIG. 1 is a partial side elevation view of a portion of an engine cooling system relevant to the present invention.
Figure 2:
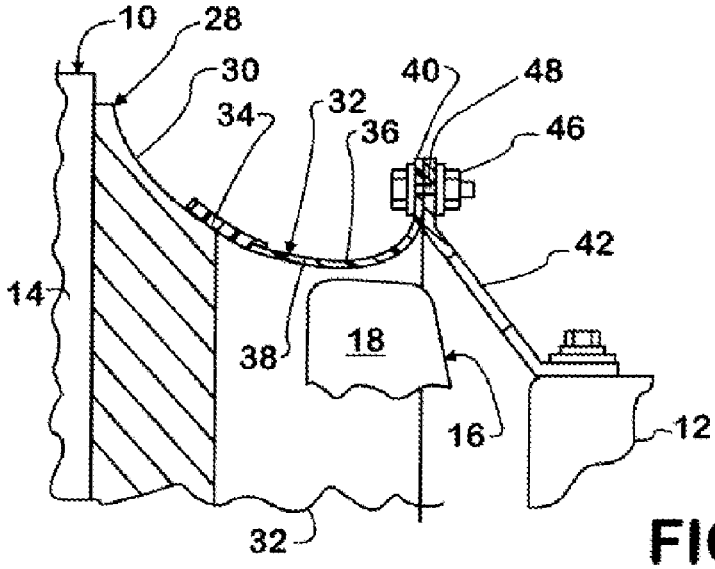
FIG. 2 is an enlarged cross section view of a portion of FIG. 1.

FIGS. 1 and 2 show a radiator 10 disposed frontally of an engine 12 in a motor vehicle. Engine 12 is representative of an internal combustion engine having an I- or V-configuration having combustion chambers where fuel is combusted to power the engine and motor vehicle.

Radiator 10 is part of the engine cooling system and comprises a core 14 having coolant passages through which engine coolant from engine 12 passes. As the coolant passes through core 14, air is drawn through the core by an engine-driven fan 16 that is behind radiator 10. As the air is drawn through core 14, heat from the coolant is rejected to the air.

Fan 16 comprises blades 18 radiating from a hub on a shaft 20 that is journaled for rotation on a mounting 22 on engine 12. A belt 24 trained around a sheave 26 on shaft 20 is also trained around a drive sheave (not shown) that rotates with the engine crankshaft, thereby operating fan 16.

A shroud 28 channels air that has been drawn through core 14 toward fan 16. Shroud 28 comprises a first part 30 and a second part 32 in axial succession. Part 30 may be considered a base shroud that comprises a non-elastomeric ring mounted on radiator 10. Part 32 comprises an elastomeric ring 34 having opposite axial ends. One of those axial ends telescopically fits over the rear margin of the non-elastomeric ring of part 30. The other axial end joins with a second non-elastomeric ring 36.

The two rings 34, 36 form a single part because they are united by a bond of elastomeric material of ring 34 with non-elastomeric material of ring 36 that occurs during the manufacturing process wherein ring 34 is insert-molded to ring 36. Ring 36 is itself formed by injection molding using a suitable material like nylon to create a part that is durable and dimensionally stable.

A zone 38 of ring 36 is in axial registration with tips of fan blades 18 to circumferentially girdle the fan. Ring 36 comprises a further zone 40 that is axially beyond zone 38 and that provides for attachment one or more parts that are either attached to or form part of the engine structure. The particular attachment here comprises struts 42, 44, each having an end fastened by a suitable fastener arrangement 46 to zone 40. Zone 40 provides a radial flange having apertures 48 through which each fastener arrangement can pass. The opposite end of strut 42 is fastened to the fan mounting, and the opposite end of strut 44, to the engine front cover.

Figure 3:
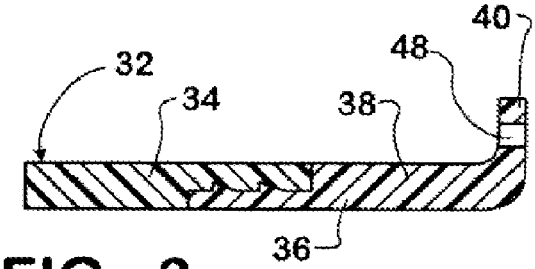
FIG. 3 is a view in the same direction as FIG. 2 showing a modified form of one of the parts by itself.

FIG. 2 shows the particular part 32 to have a curved shaped in axial cross section. FIG. 3 shows part 32 to have a somewhat different shape where zone 38 is essentially straight and parallel with the fan shaft axis and zone 40 forms what is essentially a right-angle flange at the rear end of part 32.

The ability to injection-mold ring 36 to well-controlled, stable dimensions enables shroud profile to have a close proximity to the fan blade tips for best fan efficiency. The axial thickness of zone 40 sets the axial position of the fan profile.

The elastomeric material of ring 34 allows its forward end to be circumferentially expanded for fitting over and onto the rear circular margin of part 30 to form an air-tight seal without necessarily using separate attaching parts.

While a presently preferred embodiment of the invention has been illustrated and described, it should be appreciated that principles of the invention apply to all embodiments falling within the scope of the following claims.

What is claimed is:

1. A shroud part for channeling air that a fan has drawn through a radiator core toward the fan, the part comprising a non-elastomeric ring and an elastomeric ring joined to each other through a bond of elastomeric material of the elastomeric ring with non-elastomeric material of the non-elastomeric ring.

2. A part as set forth in claim 1 wherein the non-elastomeric ring comprises a synthetic material.

3. A part as set forth in claim 2 wherein the synthetic material has first and second zones, the first zone defining an open area through the part and the second zone comprising a radial flange.

4. A method of making a shroud part for a shroud that channels air that an engine cooling fan has drawn through a radiator core toward the fan, the method comprising providing a non-elastomeric synthetic ring and joining an elastomeric ring to the synthetic ring by bonding elastomeric material of the elastomeric ring with non-elastomeric material of the non-elastomeric ring.

5. A method as set forth in claim 4 wherein the joining step is performed by insert-molding of the elastomeric ring to the non-elastomeric synthetic ring.

* * * * *